United States Patent [19]

Sisson

[11] Patent Number: 4,607,401

[45] Date of Patent: Aug. 26, 1986

[54] MIRRORED BED CANOPY

[76] Inventor: Terrell W. Sisson, 2425 Eliot St., Denver, Colo. 80211

[21] Appl. No.: 427,496

[22] Filed: Sep. 29, 1982

[51] Int. Cl.[4] ..... A47C 29/00

[52] U.S. Cl. ..... 5/414; 5/280; 5/508

[58] Field of Search ..... 5/512, 414, 284, 508, 5/280; 297/217; 135/DIG. 6; 128/372, 371, 373, 1 C, 419 N; 248/476, 480; 350/305, 289, 291; 362/130, 135, 142, 143, 144, 241, 811; D6/300-302

[56] References Cited

U.S. PATENT DOCUMENTS

| | | | |
|---|---|---|---|
| 720,877 | 2/1903 | Bloch | 350/291 |
| 842,800 | 1/1907 | Moore | 5/512 |
| 1,969,910 | 8/1934 | Simjian | 350/305 |
| 2,149,167 | 2/1939 | Gail . | |
| 2,663,218 | 12/1953 | Ranseen | 350/291 |
| 2,801,428 | 8/1957 | Streeter . | |
| 3,762,767 | 10/1973 | Powell . | |
| 3,934,284 | 1/1976 | Paletta et al. | 5/280 |
| 4,050,790 | 9/1977 | Jorwa | 350/305 |
| 4,205,684 | 6/1980 | Lassy | 128/372 |

FOREIGN PATENT DOCUMENTS

| | | | |
|---|---|---|---|
| 670541 | 1/1939 | Fed. Rep. of Germany | 5/284 |
| 1129308 | 10/1968 | United Kingdom | 5/284 |

OTHER PUBLICATIONS

Heartland Collection of Water & Wood Corp., 1500 S. Figueroa Street, Gardena, CA, 90248, Tel. 213-5328230.

*Primary Examiner*—Alexander Grosz
*Assistant Examiner*—Vinh Luong

[57] ABSTRACT

Disclosed is a novel bed canopy with large mirrored panels surrounding the bed, closely mounted, and tilted to provide the observer with the ease of viewing many large full-length images from a variety of directions. The canopy may incorporate automatically controlled side mirrored panels which enclose the bed as they are brought into position. Then by using a unique two-way mirror concept, additions of lights, audio systems, and video devices may be attached to the canopy and still maintain a clean uncluttered aesthetic appearance while having a complete functional design.

4 Claims, 8 Drawing Figures

MIRRORED BED CANOPY

BACKGROUND OF THE INVENTION

1. Field of the Invention

The present invention relates generally to bed canopies, in particular to improvements in bed canopies with mirrors.

2. Description of the Prior Art

Mirrors have been used with beds for many years for aesthetic and observational reasons, yet only in the last few years has the popularity of incorporating mirrors in beds flourished.

Present day canopies use mirrors mounted in a lattice framework above the bed. The mirrors are small squares, safety coated with rubberized backing, and laid onto the lattice framework. One of the obvious flaws with this arrangement is the framework interfering with the observed images, thus the observer views chopped or broken views. Another disadvantage is that planar distortion of the images result due to the mirrors not lying exactly in the same geometric plane whereby slight variations in height from one mirror to the next will cause this distortion. Still another disadvantage is that the canopy is so high that it reduces the size of the observed images.

The main usage of mirrors in today's beds are on headboards. They are designed as part of the bed, not of the canopy. The mirrors on the top and headboard are mounted either parallel or perpendicular to the bed's surface, thereby making it difficult to view the images unless one is either sitting up or lying down. These canopies are also limited with respect to aesthetically incorporating audio-visual components or attachments due to their initial design.

A primary object of the present invention is to provide the observers, looking at the mirrors while within the canopy, easy views of themselves by proper tilting of the mirrors towards the observers. A second object is to provide the observers with complete, full length, unbroken images by the use of large uncut mirrors. A third object is to reduce planar distortion of the images by mounting the mirrors on rigid flat panels. A fourth object is to provide a safe rugged mirrored panel without the hazard of injury from shattered glass and without the added cost of applying a rubberized safety backing. A fifth object is to provide the observer a variety of easily viewed images from different directions by having many mirrored panels properly positioned around the bed. A sixth object is to provide the observer with large images by mounting the mirrored panels close to the observer. A seventh object is to provide an improvement of the top mirrored panels of present canopies by supplying the observer with two images instead of just one. An eighth object is to provide a novel technique of having the mirrors act visually as mirrors and also as windows for various viewing applications. A ninth object is to provide mirrors on the sides of the bed, thereby enclosing it, yet have the ability to move the mirrors for access to and from the bed. A tenth object is to provide a clean uncluttered canopy design which can be combined with many additional functions with out detracting from the aesthetic appearance of the canopy.

For a better understanding of the invention and of the objects and advantages thereof, reference will be made to the following description, taken with the accompanying drawings, and to the appended claims, in which the various novel features of the invention are more particularly set forth.

SUMMARY OF THE PRESENT INVENTION

In accordance to the foregoing objects, the present invention of a bed canopy comprises large uncut mirrors mounted on rigid flat panels at the top and around the bed, with these panels properly tilted and closely mounted to the observer, thereby providing the observer with easy views of many large full-length undistorted images from a variety of directions. The top of the canopy is comprised of two mirrors both tilted towards the observer, thus providing the observer with the advantage of viewing images from two different planes rather than just one. The ends of the canopy may also include mirrored panels, again properly tilted for easy viewing. Even the sides of the canopy may have mirrored panels which can be mounted on tracks, so that when brought into the proper tilted position either manually or automatically, the mirrored panels can be easily moved for entry to and exit from the bed.

By novel replacement of ordinary mirrors on the mirrored panels with "two-way" mirrors, further additions of lights, televisions, and other visual devices may be mounted on the rear of the mirrored panels, thereby leaving a clean uncluttered aesthetic appearance to the canopy while providing a complete functional design.

Further functions can be included while complementing the aesthetic appearance of the canopy, such as general and direct lighting systems, sound systems, house plants, aquariums, murals, and soforth.

Other objects, features, and advantages of the present invention will become apparent in the following specifications and accompanying drawings.

BRIEF DESCRIPTION OF THE DRAWINGS

The present invention will be more clearly understood by reading the following detailed description while referring to the accompanying drawings, in which like reference numbers refer to like parts throughout the several views, and in which.

DETAILED DESCRIPTION OF THE PREFERRED EMBODIMENT OF THE PRESENT INVENTION

Figure 1:
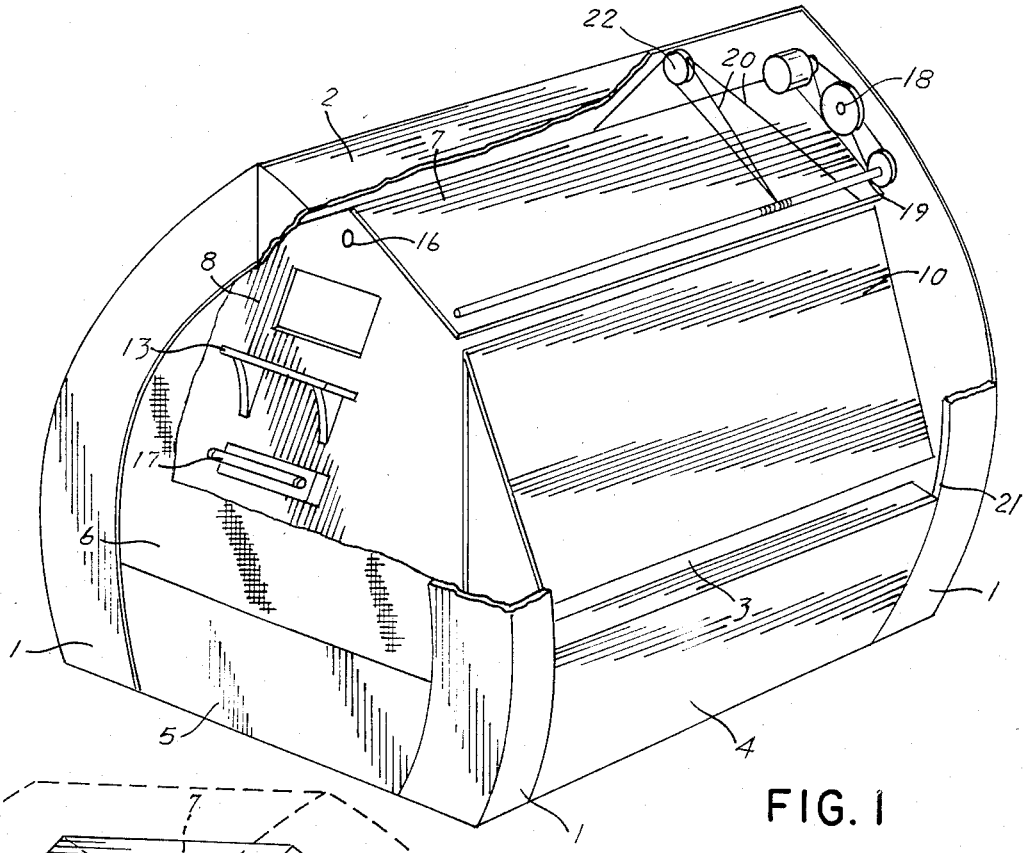
FIG. 1 is a perspective view, with portions broken away, of the preferred embodiment of the present invention.
Figure 2:
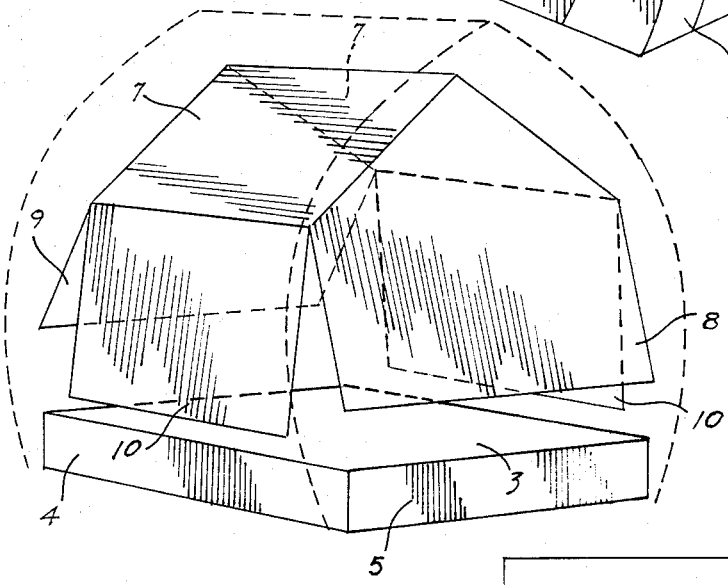
FIG. 2 is a diagrammatic perspective view of the various placements of the mirrored panels within the present invention.

Referring now to FIG. 1, the present invention thereshown is a canopy supported by four canopy support legs 1 which have attached on their uppermost sides two canopy covers 2. The side rails 4 and footboard 5 are exposed in this view of the bed 3. Directly above the footboard 5 is a mural 6 which is attached between the two adjacent canopy support legs 1. As shown in FIG. 2, the interior of the bed 3 is surrounded and enclosed on all faces by panels. These panels have their interior surfaces covered with light reflective materials that are commonly called mirrors (e.g., glass, plastic, or other substrates coated with highly reflective materials; highly glossed metals; etc.) and therefore these panels will hereafter be referred to as mirrored panels. Safety is considered when glueing the mirrored surfaces to the panels with a compound like silicon glue so if breakage occurs the glass is prevented from falling off the panel in large pieces causing possible injury. The panel material, which may be comprised of laminated sheets, such as plywood, also adds extra strength to prevent breakage of the mirrored surfaces.

Of the faces enclosing the interior of the bed, the topside face is covered by two top mirrored panels 7, the end faces are covered by a footboard mirrored panel 8 and a headboard mirrored panel 9, and the side faces are covered by two side mirrored panels 10, all shown in FIG. 2.

The reason to have a bed with a mirrored interior, aside from its aesthetic beauty, is for the occupants to observe themselves in various positions within the bed. And for these observers to obtain optimum views the mirrored panels should consist of clear, clean, flat, uncut, unbroken, large mirrored surfaces tilted towards the observer for ease of viewing thereby providing full, complete, undistorted images to the observer. Breaks, cuts, or joints in the mirrored surfaces causes undesirable distorted images, multiple reflections resulting from images being reflected from other mirrors to the mirror being viewed, and upside-down images should be kept to a minimum to decrease the observer's confusion. Also, the size of the image being viewed should be kept large as possible. This is accomplished by maintaining a short distance between the observer and the mirrored surface being viewed. In the attempt to obtain large images by having the mirrored surfaces close to the viewer, larger mirrored surfaces are required for the viewer to see full complete images, otherwise partial images will result. The angle of tilt, the size of the mirrored surface, the mirrors distance to the viewer, and the position of the viewer with respect to the mirror all determine whether the viewer receives a partial image. Therefore to maintain optimum views the present invention utilizes large mirrored surfaces placed in close proximity with and tilted towards the observer.

The importance of tilting the mirrors should be emphasized. When the mirrors are perpendicular to the surface of the bed, the observer must inconveniently sit up to view the images. From experimentation, proper tilting of the mirrors is critical to providing the observer with many easily viewed images from the same position. The top mirrored panels 7 provide optimum views when mounted parallel to the longitudinal axis of the bed and the inside edge of each panel tilted upwards from horizontal until an imaginary line extending perpendicular to the mirror's surface and from its lateral center strikes an imaginary line approximately four inches above the lateral center of the bed. When the top mirrored panels 7 are properly tilted, an observer lying in the center of the bed can view one full length image from the center of each top mirrored panel 7 above. This tilting also maintains two views as the observer moves from the center laterally across the bed. The top edges of the side mirrored panels 10 are tilted from vertical approximately ten to twenty degrees to provide two complete images from each panel, one direct image and the other a reflection from the opposite side, (on a king size bed) whereas any further tilting will result in decreased effectiveness (e.g., single images from each panel, viewing partial images while sitting up in the bed, etc.) The image from the footboard mirrored panel 8 becomes optimum when its top edge is tilted from vertical approximately twenty-five to thirty-five degrees. This permits easy viewing of an abserver lying down on the bed 3 plus provides enough room behind the footboard mirrored panel 8 for mounting accessories. The angle of tilt for the headboard mirrored panel 9 should be similar to the angle of the footboard mirrored panel 8 for aesthetic reasons, yet flexibility can be achieved for the observer by adding, as in FIG. 3, a lower headboard mirrored panel 11. The angle of the lower headboard mirrored panel 11 may be adjustable by being mounted on a pivot, also shown in FIG. 3. If the angle of the lower headboard mirrored panel 11 is to be fixed, then the bottom edge of the panel should be tilted inwardly from vertical approximately five to fifteen degrees for optimum viewing to be obtained.

Figure 4:
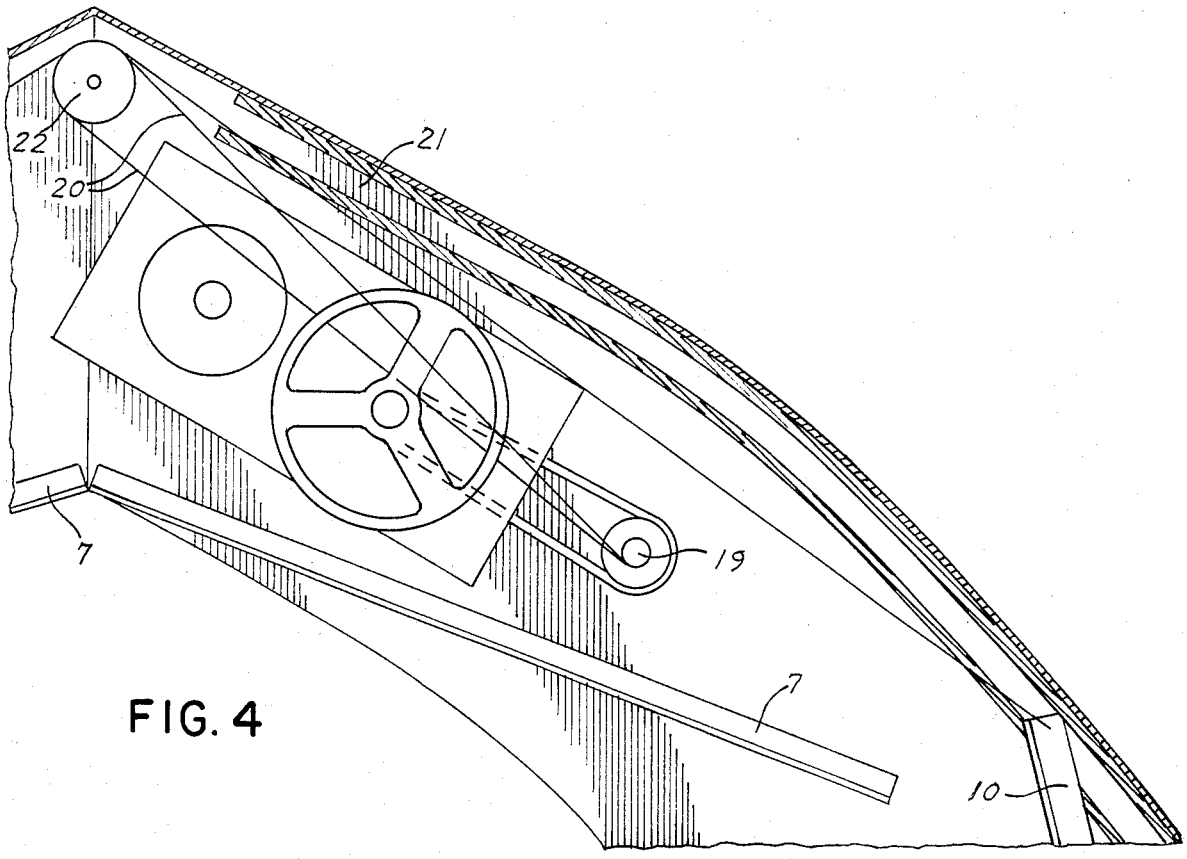
FIG. 4 is a fragmentary view of the upper portion of one canopy support showing the drive mechanics of the movable side mirrored panels.
Figure 5:
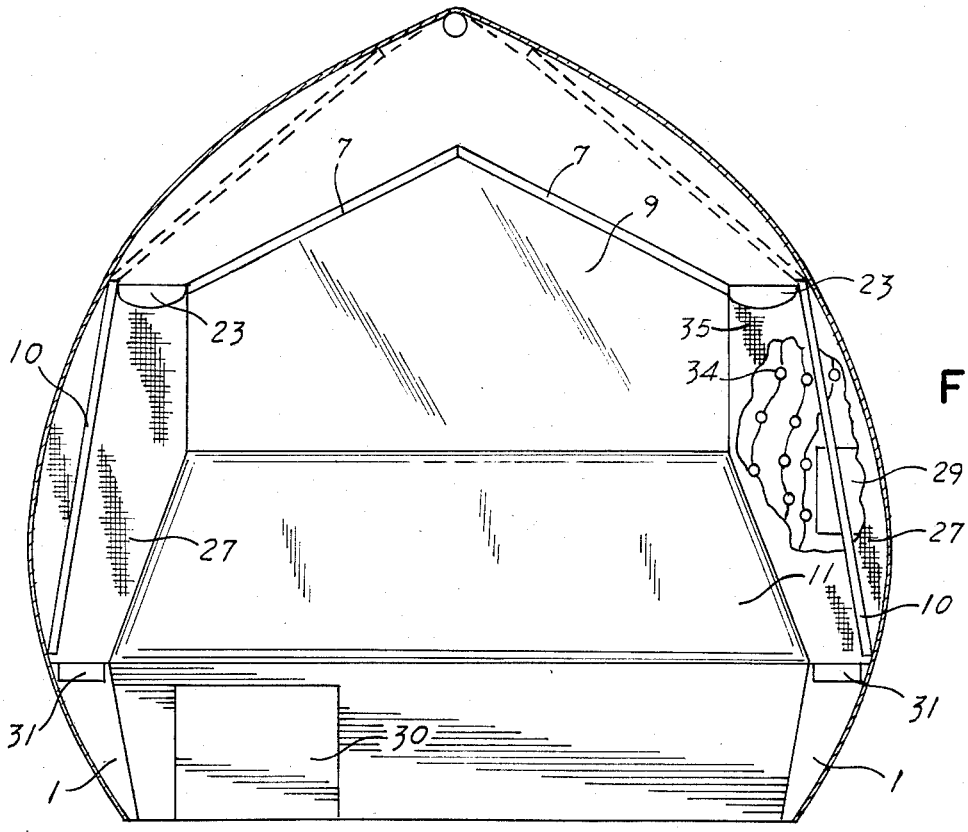
FIG. 5 is an elevation sectional view toward the headboard of the preferred embodiment.

The side mirrored panel 10 may be fixed or movable. If entrance to and exit from the bed 3 is by means of a side of the bed 3 then that side mirrored panel 10 should be moveable. One method is by providing generally vertical tracks 21 to guide the side mirrored panel 10 as it moves up and down. In FIGS. 1 and 4, an automatic panel controller 18, consisting of a motor, speed reducers, and positioning electronics, turns shaft 19 thereby wrapping and pulling cables 20 that are connected to the side mirrored panels 10 via idler pulleys 22. FIG. 5 shows the resultant position the side mirrored panels 10 will assume as they travel from their lower position to the upper stored position (shown in dashed lines). This particular design results in good aesthetic appearance although other generally vertical track arrangements, whether curved, straight, or a combination of both may be used. As shown in FIG. 5, the hinge-mounted spring loaded panels 23 hide the gap between the top mirrored panels 7 and the side mirrored panels 10 by pivoting out of the way in sliding contact with the side mirrored panels 10 as they travel in an arcuate path upwardly or downwardly.

Figure 7:
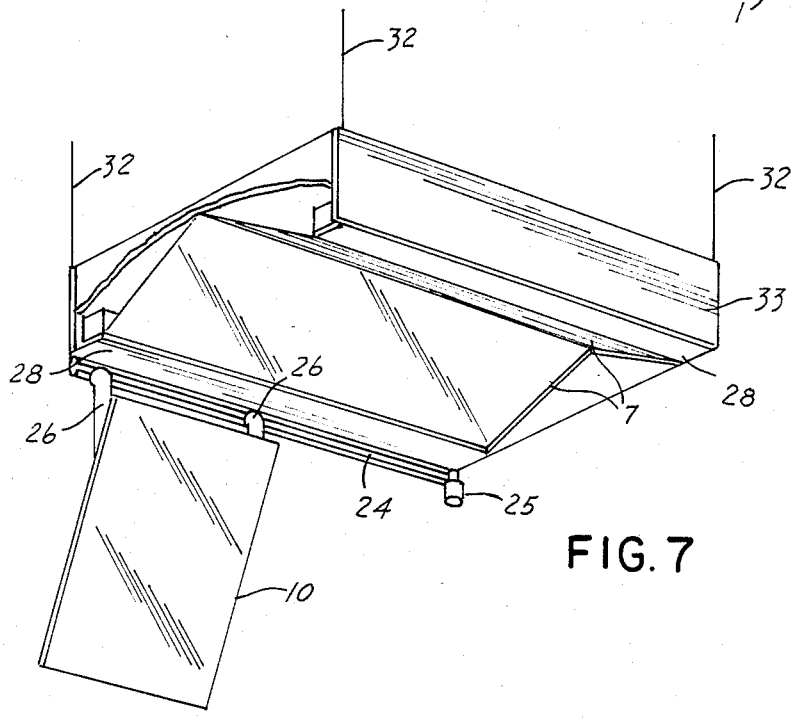
FIG. 7 is a perspective view, with a portion broken away, of a similar embodiment as shown in FIG. 6, except supported from the ceiling and with movable side panel attached.

A simpler track arrangement is shown in an alternate embodiment in FIG. 7, wherein a horizontal track 24 is mounted to a ceiling-mounted canopy and has a side mirrored panel 10, attached by tilting supports 26, that rolls along the horizontal track 24, thereby permitting lateral movement. If automatic movement is desired a conventional curtain controller 25 may be utilized. Again these tracks may be straight, curved, or both to accomodate storage of the side mirrored panels 10 at the side or ends of the bed.

Figure 3:
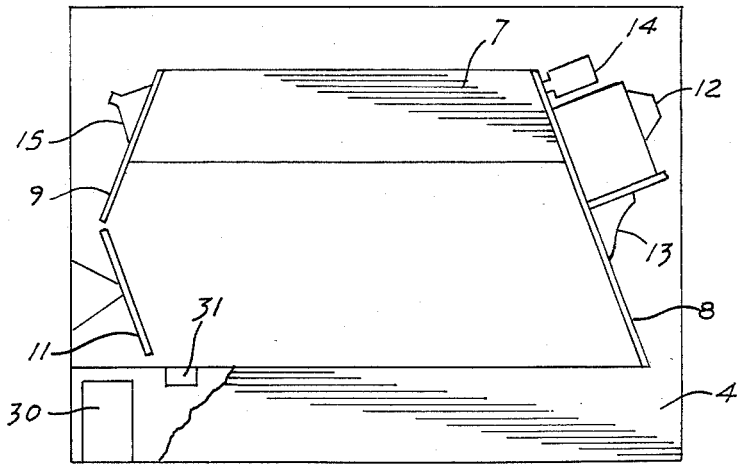
FIG. 3 is a cross-sectional view along the longitudinal axis of the preferred embodiment of the present invention.

By covering the surface of any of the panels with a partial reflective surface, commonly known as a "two-way" mirror, and removing portions of the panel 16, as shown in FIG. 1, light can be transmitted through the entire thickness of the mirrored panel. This permits the addition of visual devices to the canopy including the following examples. One usage of this two-way mirror concept is the mounting of a television 12 on a platform 13 which projects its video image through the footboard mirrored panel 8 to the observers within the canopy. Although a television is mentioned, any video projecting device may be used. Another usage of the two-way mirror concept is obtained by mounting a video camera 14 or any video receiving device over the removed portion of the panel 16 so light can pass through the entire panel to the video camera 14 thus permitting filming or observing the interior of the canopy. Yet another usage of this two-way mirror concept comprises projecting light from the rear of any panel to the inside of the canopy. As shown in FIG. 3, the light 15 is mounted on the headboard mirrored panel 9 for this purpose.

To make the external appearance of the canopy more appealing, the employment of a decorative mural 6, which can be made of glass, cloth, plastic, or other sheet materials may be used to hide the rear of the mirrored panels. Then to enhance the appearance of a translucent mural 6, a light fixture 17 may be mounted onto the rear of the mirrored panel, as shown in FIG. 1.

Lighting systems may be mounted on the canopy for many reasons (e.g. aesthetic appearance, mood enhancement, entertainment, etc.) They may be single colored, multicolored, individual lamps, clusters of lamps, or assembled sets and controlled by dimmers, color organ controllers, and other similar devices. In FIG. 5, the lighting sets 27 are mounted in the corners of the canopy supports 1. Lighting sets 27, in particular, are comprised of three colors of large bulbed Christmas lights 34 (each color separately controlled) enclosed in a translucent material 35. In FIG. 7, lighting boxes 28 are mounted on the periphery or outside edge of the top mirrored panels 7. Although hereshown the lighting boxes 28 are mounted only on two sides, all four sides surrounding the top mirrored panels 7 can have light boxes 28 attached.

Figure 6:
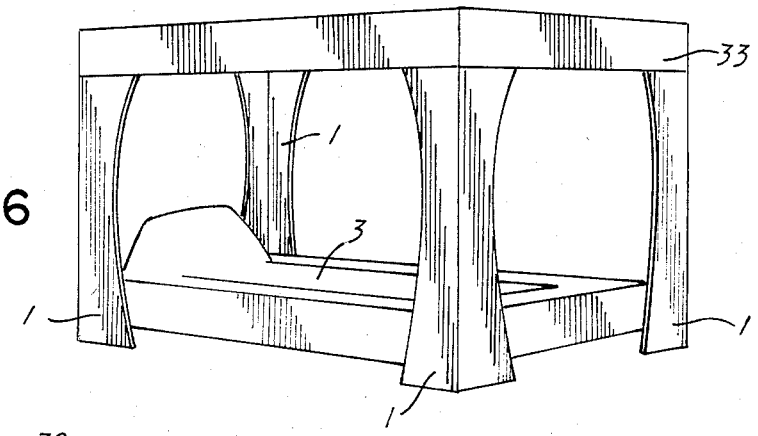
FIG. 6 is a perspective view of an alternate embodiment of the present invention.
Figure 8:
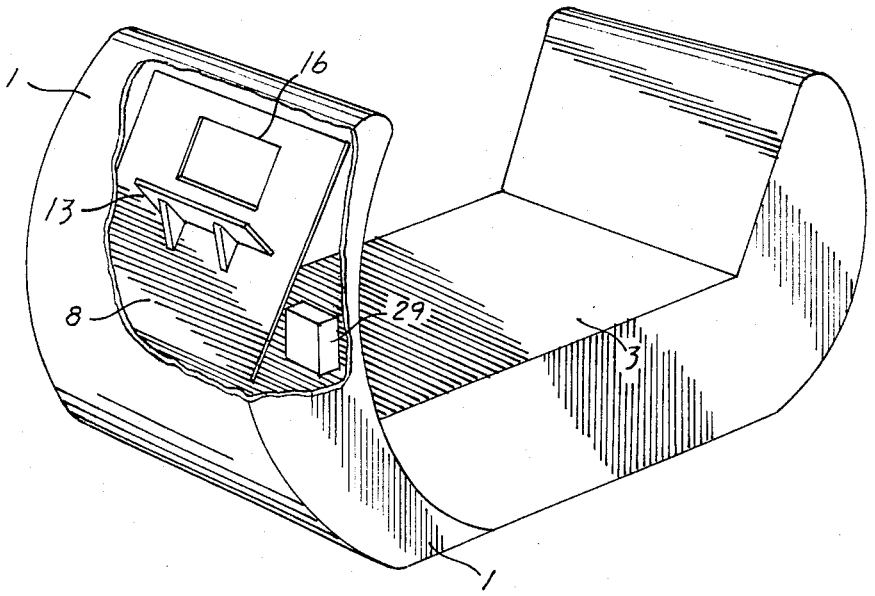
FIG. 8 is a perspective view, with a portion broken away, of a further embodiment of the present invention.

In FIGS. 6, 7, and 8 alternate embodiments of the present invention are shown, exemplifying the versatility of the invention. FIG. 7 shows a canopy consisting of an encasing framework 33, two top mirrored panels 7, and light boxes 28 suspended from ceiling supports 32. The canopy in FIG. 6 is similar to the one in FIG. 7 except it is supported from below by canopy supports 1. FIG. 8 shows an open-topped canopy comprising of a footboard mirrored panel 8, speakers 29, and canopy supports 1 partially covering the bed 3. A lighting system may also be easily incorporated in this canopy design if desired.

Speaker systems may be mounted on the canopy at the periphery of the top mirrored panels 7, as in similar relation the light boxes 28 were mounted in FIG. 7, or even on the canopy supports 1, as in FIG. 8. A lighting set 27 and speakers 29 may be combined and mounted in the canopy supports 1, as shown in FIG. 5.

Since the canopy may be totally enclosed it is conceivable that bed canopies in the future will become modular in design to fit into prebuilt spaces as shower and bath combinations are today and as energy becomes more costly these modules might be heated and cooled rather than the entire house or building at night. Therefore, devices for conditioning the air such as an air conditioner 30 or heat pump may be combined with fans 31 and incorporated as part of the present invention, as shown in FIGS. 3 and 5, for added comfort.

While the preceding description contain many specifics, these should not be construed as limitations on the scope of the invention, but rather as an exemplification of preferred embodiments thereof. Accordingly, the scope of the invention should be determined not by the embodiments illustrated, but by the appended claims, and their legal equivalents.

I hereby claim:

1. Canopy apparatus adapted to surround and enclose a bed, comprising:

a plurality of mirrored panels positioned above and around the bed, at least one of said panels being angularly adjustable relative to each other and to the bed;

track means positioned a spaced distance upwardly from said bed for moveably supporting one of said panels in such a manner that said track supported mirror is moveable laterally in relation to said bed and to said other panels; and at least one mirrored panel having a cut-out portion adapted to have positioned adjacent thereto a visual image producing device visible and observable from the bed.

2. Bed canopy apparatus for covering a bed surface, comprising:

at least one mirror panel positioned a spaced distance above the bed surface a sufficient distance to allow convenient access to, and freedom of movement on, the bed surface;

track means extending from the side of the bed surface upwardly and inwardly over the top of the bed surface for supporting said mirror panel, the uppermost reaches of said track means being above the bed surface, said mirror panel being moveably mounted in said track means in such a manner that said mirror is translatable through a path extending from the side of the bed surface to a position above the bed surface.

3. Bed canopy apparatus, comprising a box-like frame structure adapted for being positioned a spaced distance above a bed, and two planar mirror panel mounted in said frame, each of said panels being oriented in a plane parallel to the longitudinal axis of the bed and oriented at an obtuse angle with respect to each other, said panels being adjustably mounted in such a manner that the obtuse angular relation between them can be varied.

4. The bed canopy apparatus of claim 3, comprising a horizontal track attached to the bottom edge of a side of said frame and a mirror panel moveably mounted in said track, said mirror also being rotatably adjustable about an axis parallel to said track.

* * * * *